US006253820B1

(12) United States Patent
Landan et al.

(10) Patent No.: US 6,253,820 B1
(45) Date of Patent: Jul. 3, 2001

(54) LABEL APPLYING APPARATUS AND METHOD THEREFOR

(75) Inventors: Daniel A. Landan, Fairfield; Joseph Dyke, Stratford, both of CT (US)

(73) Assignee: Inline Plastics Corporation, Shelton, CT (US)

( * ) Notice: Subject to any disclaimer, the term of this patent is extended or adjusted under 35 U.S.C. 154(b) by 0 days.

(21) Appl. No.: 09/340,285

(22) Filed: Jun. 28, 1999

(51) Int. Cl.[7] ..... B65C 1/02; B65C 1/04

(52) U.S. Cl. ..... 156/542; 156/566; 156/DIG. 3; 53/136.1; 53/136.3

(58) Field of Search ..... 156/540, 541, 156/542, 556, 566, DIG. 3, DIG. 4; 53/136.1, 136.3, 136.4, 329

(56) References Cited

U.S. PATENT DOCUMENTS

| | | | |
|---|---|---|---|
| 2,584,633 | | 2/1952 | Southwick, Jr. . |
| 4,331,498 | | 5/1982 | Pagay et al. . |
| 4,414,056 | | 11/1983 | Buchholz et al. . |
| 4,701,238 | | 10/1987 | Boucher . |
| 5,118,375 | | 6/1992 | Malachowski et al. . |
| 5,122,109 | * | 6/1992 | Segalowitz et al. ..... 493/344 |
| 5,185,983 | * | 2/1993 | Slater ..... 53/136.3 |
| 6,155,322 | * | 12/2000 | Landan et al. ..... 156/542 |

* cited by examiner

*Primary Examiner*—Richard Crispino
*Assistant Examiner*—Sue A. Purvis
(74) *Attorney, Agent, or Firm*—Melin I. Stoltz

(57) ABSTRACT

By providing a system for controllably applying and wrapping a label into direct, secure, affixed adhesive engagement with the flange or lip of a container, a dependable, effective, and reliable label applying apparatus and label application method is realized which securely affixes a tamper evident label in its entirety to a product container on a continuous production basis, totally eliminating unwanted tenting of labels. By employing the present invention, a product holding container, having a forwardly protruding lip or flange, is advanced towards a label dispensing zone with the label positioned for contacting the top surface of the forwardly protruding flange. Once the label is attached thereto, the label bearing flange/lip is advanced into contact with the label wrapping cam means for placing the label in the desired position. Thereafter, the label wrapped flange or lip is passed through cooperating rollers which force the label into secure affixation with the top and bottom surfaces of the protruding lip or flange.

16 Claims, 11 Drawing Sheets

LABEL APPLYING APPARATUS AND METHOD THEREFOR

TECHNICAL FIELD

This invention relates to production equipment and application methods for applying and affixing labels to packages on a production basis and, more particularly, to such production equipment and application methods which assure secure affixation of the label in its entirety to the package.

BACKGROUND ART

Numerous systems have been developed for applying and affixing labels to a wide variety of packages for a wide variety of different purposes. One such application that has received substantial attention is the affixation of product identifying labels to pre-packaged food products such as fresh bakery items. Typically, fresh bakery items are packaged in transparent plastic containers and product identification labels and/or tamper-evident labels are affixed to the containers.

In many instances, the transparent plastic container comprises a clamshell construction, with one edge of the container forming the entry zone, with the entry zone incorporating locking means for holding the container in the closed position. In order to provide for the secure retention of the fresh bakery product in the container, as well as provide a tamper evident construction, the product identifying or tamper-evident label is placed over the leading edge of the container which forms the entry zone. In this way, a consumer is immediately aware if any package has been opened.

Although this type of construction is widely used in the food industry, particularly with bakery items, one problem that has continued to plague the industry is the inability of the production equipment to eliminate tenting of the label as a label is affixed to the product containing packages. In most packages of this nature, a forwardly protruding ledge or lip is employed on which the locking means are mounted. As a result, when product identifying or tamper evident labels are mounted to these packages in a manner that surrounds the protruding lip or ledge, the label is affixed to the edge of the lip and the top and bottom surfaces of the package or the sides of the package. However, the label is not affixed directly or completely to the top and bottom surfaces of the protruding lip or ledge of the package.

As a result, the label has a characteristic tenting effect, wherein the label is secured along one of its ends to the top or upper side surface of the package and, at its other end, to the package bottom or its lower side surface, with the middle of the label affixed to the edge of the protruding lip. However, the middle portion of the label is spaced away from the top and bottom surfaces of the protruding lip, leaving an open spaced zone therebetween. This construction is often referred to as tenting.

In some products of this general nature, a product identifying label is placed on the top of the package in order to enable the consumer to easily read the information printed thereon. As a result, a separate, small fastening label is typically mounted to the protruding lip of the container in order to provide a tamper-evident seal.

Although both consumers and manufacturers prefer to have this tamper evident label wrapped tightly around the protruding container lip or flange, prior art systems have been incapable of providing an assembly system which satisfies this need. Instead, these tamper evident labels typically contact the front edge of the protruding lip or flange and extend therefrom into contact with the side surfaces of the container which are formed directly above and below the protruding lip/flange. However, little or no contact is made with the top surface and/or bottom surface of the protruding lip/flange, producing a similar tenting effect.

Although most producers and product packaging companies have sought to eliminate this tenting effect by using a wide variety of alternate constructions, no system has been developed for effectively resolving this problem. As a result, although substantial effort has been expended in an attempt to reduce or eliminate this visually undesirable tenting effect, no production equipment or method has been produced, prior to the present invention, which satisfies this long-felt need.

Therefore, it is a principal object of the present invention to provide label applying apparatus and label application methods which are capable of securely affixing labels to products on an automated basis with the entire label being secured to the desired product.

Another object of the present invention is to provide label applying apparatus and label application methods having the characteristic features described above wherein the labels are securely affixed to product retaining packages regardless of the construction employed for the product retaining package.

Another object of the present invention is to provide label applying apparatus and label application methods having the characteristic features described above wherein labels are securely affixed to packages spanning the entry portal for the package and providing secure tamper-free and/or tamper-evident closure of the package.

Other and more specific objects will in part be obvious and will in part appear hereinafter.

SUMMARY OF THE INVENTION

By employing the present invention, all of the difficulties and drawbacks found in the prior art are eliminated and a dependable, effective, reliable label applying apparatus and label application method is attained which assures continuous application of labels to products on a production basis in a continuous, substantially trouble-free operation. In accordance with the present invention, means are provided for securely affixing the label in its entirety to the protruding lip or flange of the container in a manner which securely wraps the label about the surfaces forming the protruding lip/flange. As a result, secure affixation of the label in its entirety to the lip/flange of the product container is realized and the unwanted, prior art tenting of labels is eliminated.

In order to provide the secure affixation of a label in its entirety to a product container having a forwardly protruding lip or flange, with the label being effectively wrapped about the protruding lip or flange, precise timing during the label affixation process is required, along with label wrapping cam means. In addition, a pair of cooperating compression rollers are employed with at least one roller being formed from soft, flexible material, for controllably securing the label in its entirety to the protruding lip/flange of the container, regardless of the configuration or shape of the lip/flange. In this way, unwanted label tenting is eliminated and the desired secure, continuous, affixation of the label in its entirety to the product retaining package is assured.

In accordance with the present invention, a product retaining package having a forwardly protruding lip or flange is advanced towards a label dispensing zone with the label positioned for contacting the top surface of the forwardly protruding lip/flange. Due to the variety of containers which are employed in this industry, protruding flanges and lips comprise widely, diverse configurations. However, one typical configuration, which is also one of the most difficult to have a tamper evident seal securely wrapped thereon, comprises an L-shaped upper flange member and a flat lower flange member which is held in contact with the upper flange member. As a result, the upper flange member has a vertical front-facing edge about which the label must be wrapped.

Once the label is attached to the top surface of the upper flange portion of the forwardly protruding lip or flange, the label extends from the container in a substantially horizontal plane. Then, the label bearing container is brought into contact with label wrapping cam means which folds the label about the upper flange member and lower flange member.

Although the label wrapping cam means is able to arcuately fold and wrap the tamper evident label about both the upper flange member and lower flange member, the cam means is incapable of securely affixing the tamper evident label to both the top and bottom surfaces of the protruding lip/flange. Typically, if no further label securement steps were taken, the tamper evident label would become dislodged from the lower flange member and tend to return to its original, horizontal configuration.

In accordance with the present invention, this desired secure affixation of the tamper evident label to the top and bottom surfaces of the lip/flange is achieved by advancing the label wrapped container to a pair of rollers and guiding the protruding lip/flange to pass between the rollers. In the preferred embodiment, the upper roller is formed from generally hard material, while the lower roller comprises comparatively soft, flexible or compressible material.

By passing the label wrapped flange between the two cooperating rollers, the tamper evident label is compressed onto the lip/flange of the container, effectively forcing the label into secure bonded engagement with the top surface and bottom surface of the protruding lip/flange. In addition, in view of the configuration of the flange, as detailed above, the lower roller is preferably formed from compressible, flexible, or deformable material in order to directly contact the flat surface of the lower flange member as well as the surfaces of the L-shaped upper flange member. In this way, the tamper evident label is securely affixed to the flange, in its entirety, thereby preventing any dislodgement of the label therefrom.

By employing this invention, each and every label is securely affixed, in its entirety, to any desired lip/flange configuration employed on a product retaining package, regardless of the construction of the lip/flange. In addition, by assuring secure, adhesive bonded engagement of the label with the bottom surfaces of the forwardly protruding lip or flange, as well as the front end surfaces and the top surface of the flange, unwanted label tenting is eliminated and securement of the label in its entirety to the package is provided.

The invention accordingly comprises the several steps and the relation of one or more of such steps with respect to each of the others, and the apparatus embodied in the features of construction, combination of elements and arrangement of parts which are adapted to effect such steps, all as exemplified in the following detailed disclosure, with the scope of the invention being indicated in the claims.

THE DRAWINGS

For fuller understanding of the nature and objects of the present invention, reference should be had to the following detailed description taken in connection with the accompanying drawings, in which.

DETAILED DESCRIPTION

By referring to FIGS. 1–11 along with the following detailed disclosure, the construction and operation of the label applying and securing apparatus and the label application method of the present invention can best be understood. In this detailed disclosure, the preferred construction and method are fully detailed and shown. However, as will be evident to one of ordinary skill in the art, alternate embodiments of this invention can be made without departing from the scope of this invention. Consequently, the embodiment depicted in FIGS. 1–11 and detailed in the following disclosure exemplifies the preferred embodiment of the present invention without limiting the present invention to this particular embodiment.

Figure 1:
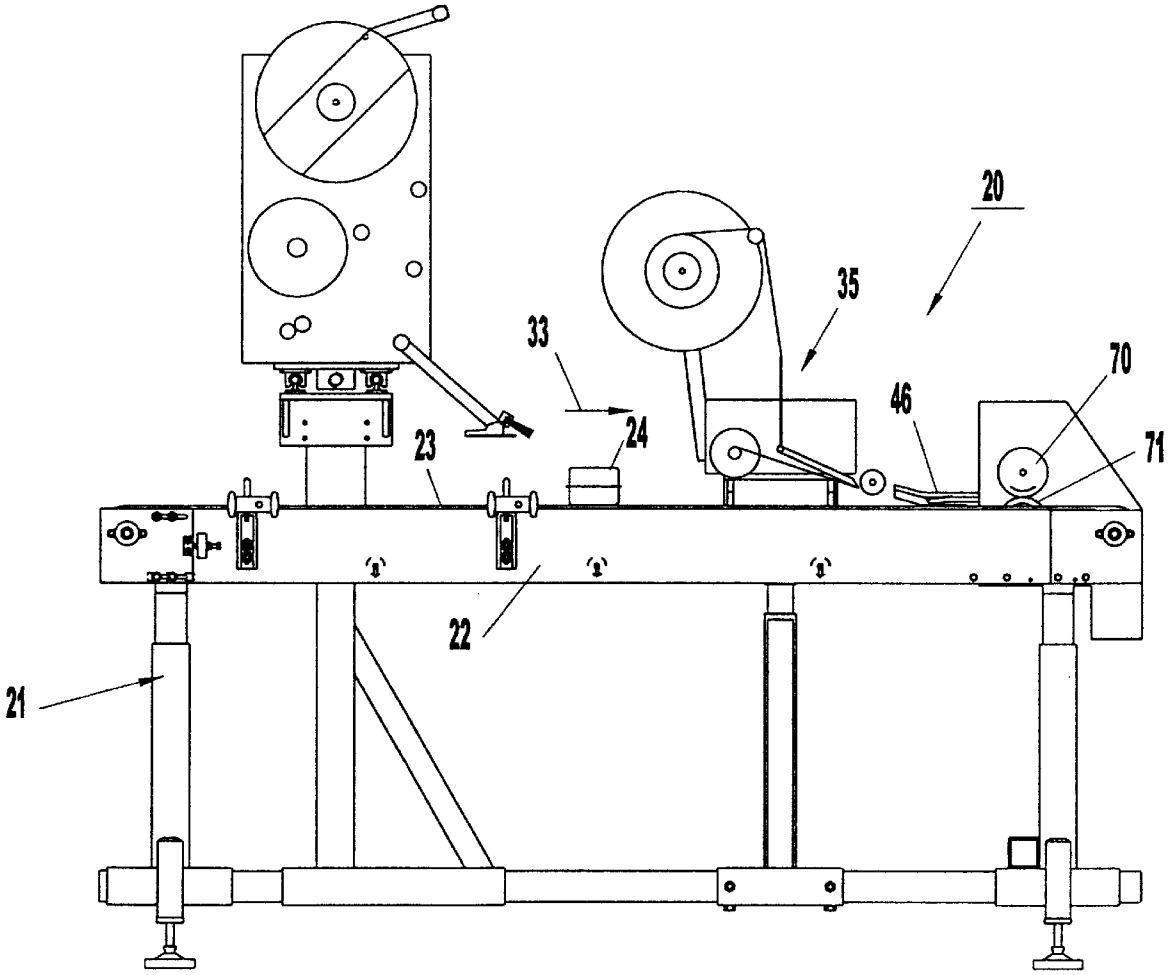
FIG. 1 is a side elevation view of the label applying apparatus of the present invention.
Figure 2:
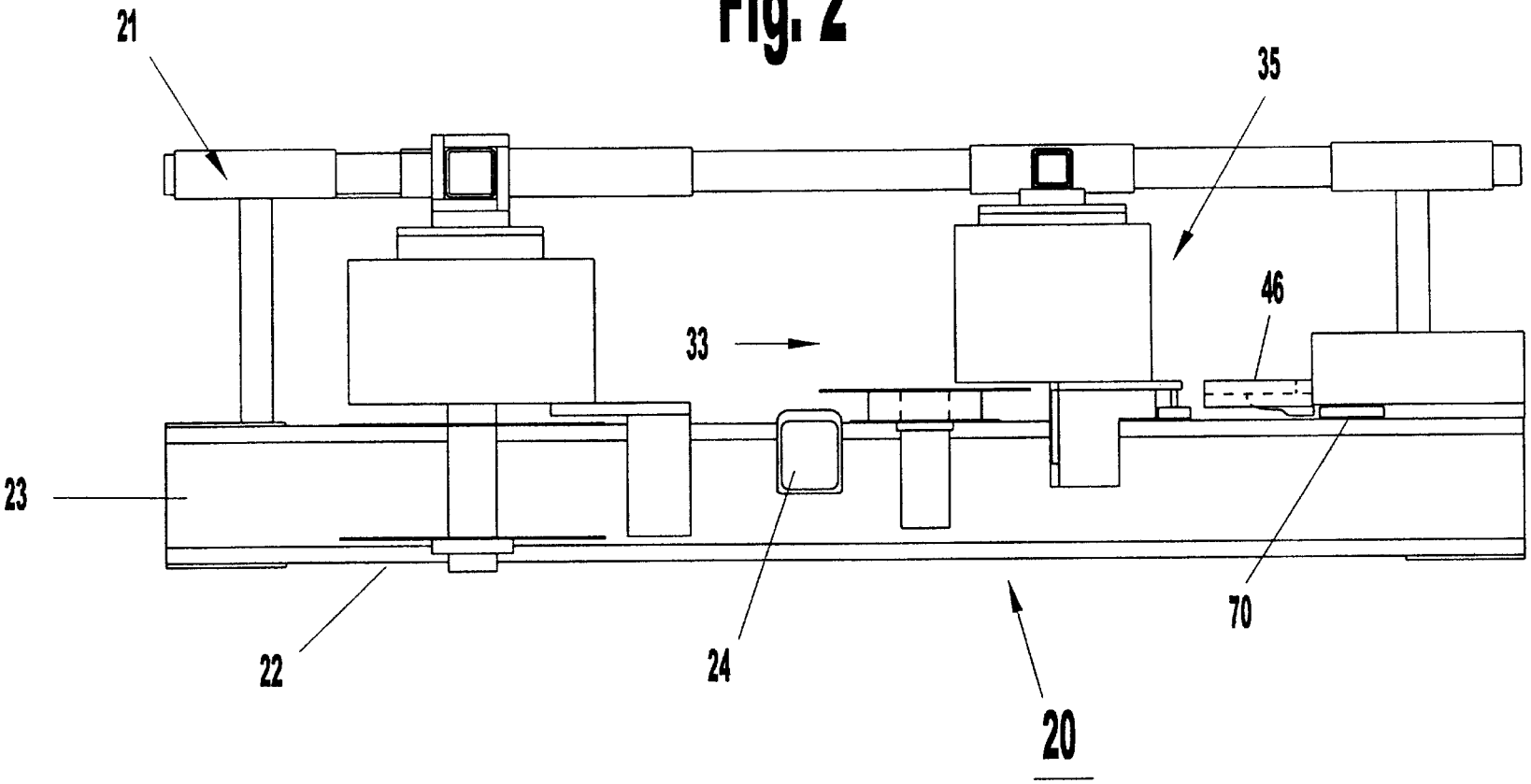
FIG. 2 is a top plan view of the label applying apparatus of FIG. 1.

As shown in FIGS. 1 and 2, label applying and securing apparatus 20 comprises supporting frame structure 21 on which is mounted supporting table 22 which incorporates conveyor 23. In the preferred construction, conveyor 23 comprises an endless or continuous belt on which the desired product containers 24 are positioned and advanced in the direction of arrow 33 for secure affixation of label 25 to container 24.

Product container 24 typically comprises a protruding lip or flange 28 having virtually any desired size or shape. However, by employing label applying and securing apparatus 20 label 25 is able to be securely affixed to lip/flange 28 of container 24 in the desired manner. For exemplary purposes, product container 24 is depicted in the drawings as a generally rectangular shaped container having a clamshell configuration. In addition, container 24 comprises upper portion 26, lower portion 27, and protruding lip or flange 28 which defines the forward edge of product container 24 and the interconnecting juncture between upper portion 26 and lower portion 27, forming the entry portal for product container 24.

As discussed above, lip/flange 28 may comprise a wide variety of alternate configurations or constructions.

Figure 3:
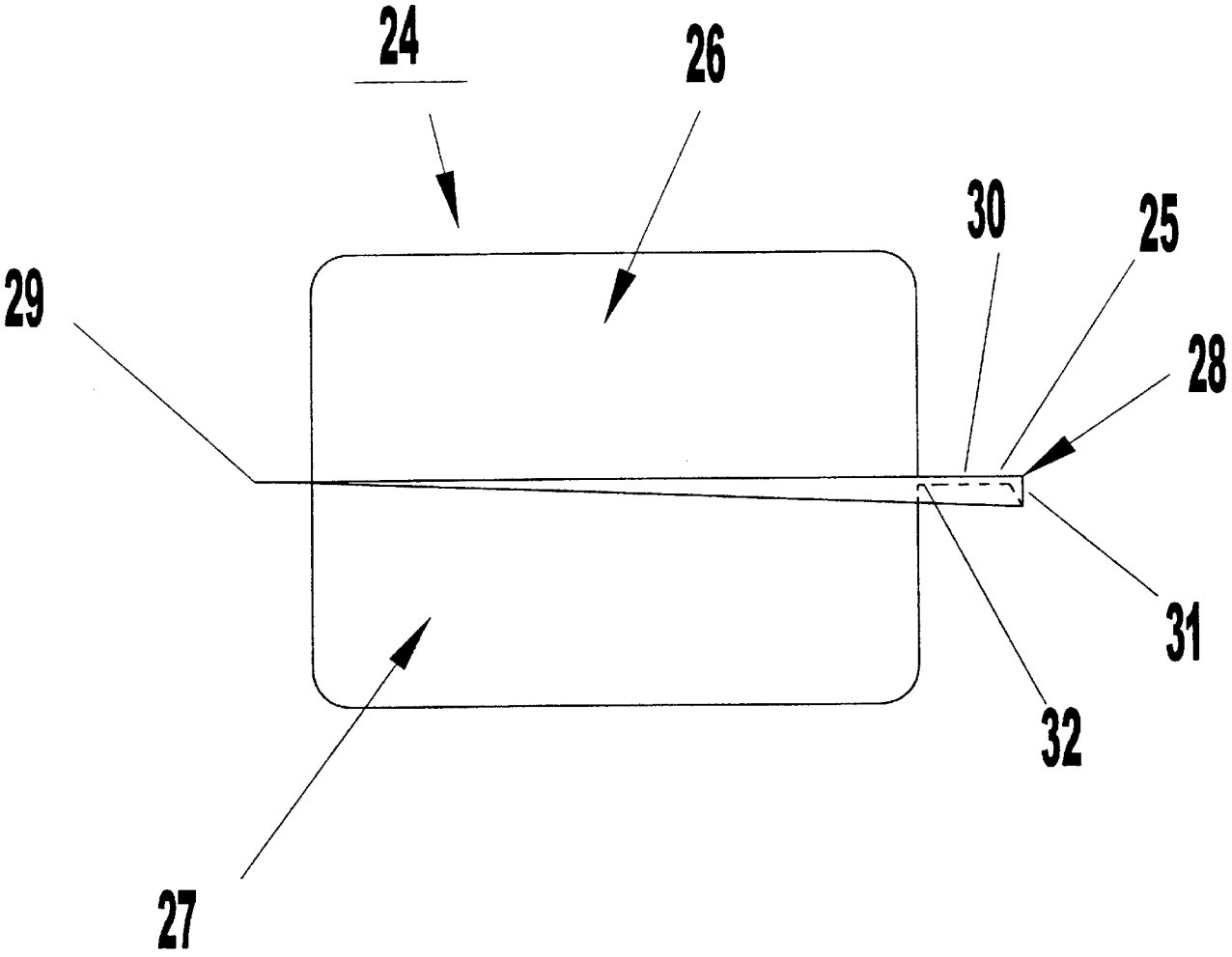
FIG. 3 is a side elevation view of a product container incorporating a label completely wrapped on the protruding lip/flange thereof after passing through the label applying apparatus of the present invention.

However, in FIG. 3, one typical construction is depicted which represents a construction which is one of the most difficult configurations on which a tamper evident label is secured.

In this construction, container 24 comprises a clam-shell design formed from upper portion 26 and lower portion 27, which are affixed to each other along a rear edge 29 which forms the pivot axis therefor. Upper portion 26 comprises an L-shaped forwardly protruding lip member defined by substantially flat enlarged top surface 30, shown in a generally horizontal position, and short, flat wall member 31 extending substantially perpendicularly from flat top surface 30 at its distal end. As depicted, when container 24 is closed, wall member 31 forms a vertically depending flat, forward-facing wall or edge as the leading element of lip/flange 28.

In addition, lower portion 27 comprises an outwardly extending flat bottom surface 32 which is constructed for mating, contacting underlying alignment with flat surface 30 of upper portion 26. Typically, container 24 comprises locking tabs or lugs formed on lip/flange 28 to securely maintain flat surface 30 and 32 in secure, engaged, juxtaposed, overlying relationship with each other.

As shown in FIG. 3, label 25 is securely affixed to protruding lip/flange 28 of container 24 in the desired manner. As depicted, label 25 is securely wrapped about lip/flange 28, with label 25 in secure, affixed interengagement with top surface 30, depending wall 31 of upper portion 26, as well as bottom surface 32 of lower portion 27. In addition, by employing label applying and securing apparatus 20 of the present invention, label 25 is also secured to the inside surface of wall member 31, assuring secure, intimate, bonded engagement of label 25 with all exposed surfaces of protruding lip/flange 28.

By employing label applying and securing apparatus 20 of the present invention, unwanted tenting of label 25 on container 24 is completely eliminated. Instead, label 25 is securely affixed to lip/flange 28 of container 24, in complete wrapped interengaged relationship therewith, providing the consumer with a dependable and reliable method for determining if a package has been opened by another customer.

In order to securely affix tamper evident label 25 to each product container 24 in the desired manner and securely close the entry portal thereof, product container 24 is advanced into cooperative operational engagement with labeling dispensing station 35 of label applying and securing apparatus 20. As detailed below, labeling dispensing station 35 dispenses the desired tamper evident label 25 for affixation on product container 24 and secures one portion of label 25 to top surface 30 of the protruding lip/flange 28 of product container 24. Thereafter, as detailed herein, the remainder of label 25 is secured to container 24, along both the side and bottom surfaces of lip/flange 28. Each of the steps involved in achieving the desired, secure affixation of label 25 to lip/flange 28 are performed sequentially in a precisely timed manner, in order to assure the desired result of securely closing and sealing upper portion 26 and lower portion 27 to each other along flange 28, with label 25 snugly wrapped directly to flange 28.

Figure 4:
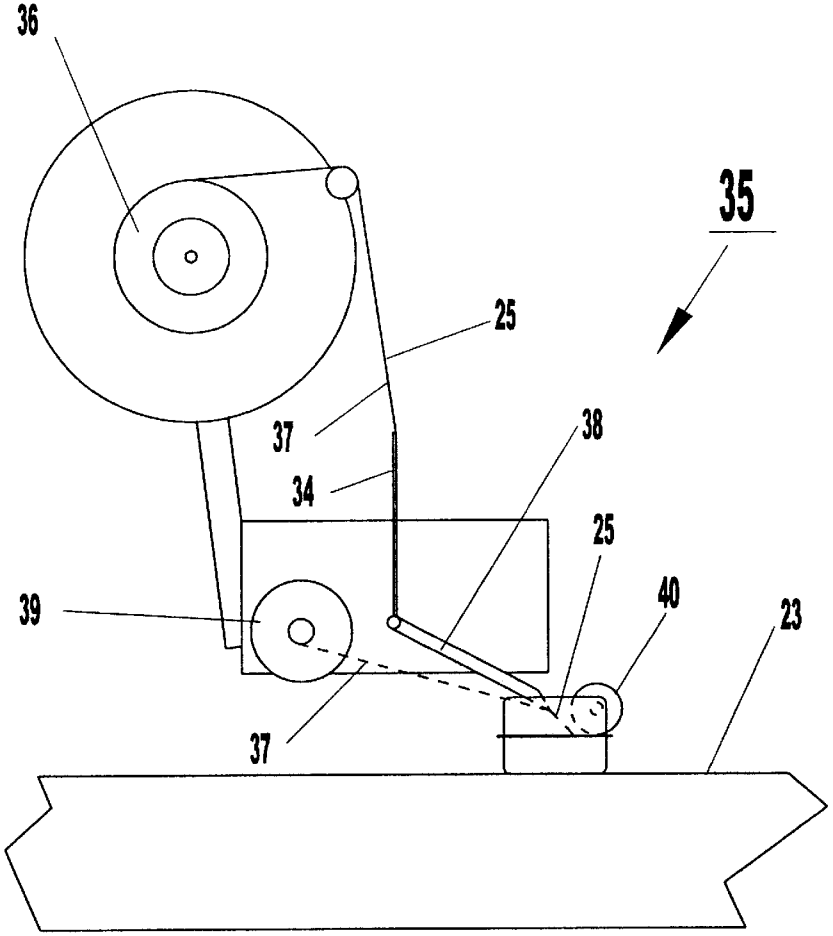
FIG. 4 is a side elevation view depicting the label dispensing system which forms a part of the label applying apparatus of the present invention.

In FIGS. 1, 2 and 4, label dispensing station 35 is shown as preferably incorporating a supply of labels retained on spool 36. In the typical construction, an elongated, substantially continuous backing sheet or web 37 is employed for supportingly retaining a plurality of labels 25 thereon. Each label 25 is separated from each adjacent label 25 along its ends by die cutting the labels after printing. In this way, ease of separation of each label 25 from an adjacent label 25 is provided. Labels 25 and web 37 extend from spool 36 onto guide rails 34 and 38 which controllingly advance and direct labels 25 and web 37 from spool 36 to the precisely desired position.

In order to assure the secure affixation of label 25 to container 24, each label 25 comprises an adhesive surface, using any desired prior art adhesives or adhesive systems. Preferably, labels 25 are coated with adhesive material when manufactured and then covered with protective backing sheet or web 37, as discussed above.

As shown in FIGS. 1, 2, and 4, in order to separate labels 25 from web 37 and enable the adhesive faced surface of label 25 to be positioned in the path of container 24, guide rail 38 incorporates a stripper or peeling element at its distal, terminating end which continuously separates web 37 from label 25. In addition, a take-up reel 39 is preferably employed for continuously rolling web 37 onto reel 39 as labels 25 are removed therefrom. In this way, each label 25 is positioned with the adhesive surface thereof facing lip/flange 28 of on-coming product container 24.

As best seen in FIGS. 2 and 4, each label 25 is suspended from web 37 at the terminating end of guide rail 38, extending in the flow path of product container 24. The adhesive surface of label 25 is positioned facing the approaching container 24 to assure abutting contacting interengagement of label 25 with top surface 30 of lip/flange 28 of product container 24. As product container 24 is advanced into contact with label 25, the label automatically adheres to top surface 30 of lip/flange 28.

In addition, in order to assure the secure bonded engagement of label 25 with top surface 30 of lip/flange 28, roller 40 is preferably employed. By positioning roller 40 directly adjacent the location at which label 25 is affixed to lip/flange 28, with a height from conveyor 23 substantially equivalent to the height of top surface 30 of lip/flange 28, roller 40 contacts label 25 and forces label 25 into secure engagement with lip/flange 28. Once label 25 is affixed to the top surface 30 of flange 28 in the manner detailed above, label 25 extends from lip/flange 28 in a substantially horizontal configuration and remains in this position until reaching label wrapping cam member 46.

By referring to FIGS. 5–9, along with the following detailed discussion, the construction and operation of the preferred embodiment of label wrapping cam member 46 can best be understood. In this embodiment, label wrapping cam member 46 comprises an elongated, continuous upper plate 47 and a lower plate 48 positioned in juxtaposed, spaced, aligned relationship with each other. However, if desired, cam member 46 may be constructed in a variety of alternate configurations such as in a single piece construction or using tubular or round stock.

Upper plate 47 comprises a substantially flat, elongated, rear section 49, which is operationally mounted in a substantially horizontal plane. The front or forward portion of upper plate 47 comprises ramped, sloping section 50 which is engaged with rear section 49 and extends therefrom at an angle ranging between about 5° and 70°. The construction of upper plate 47 is completed by top surface 52, bottom surface 53, and smooth, rounded side edge 51 which extends continuously along sloping section 50 and rear section 49, forming a flange guiding surface as detailed below.

Figure 5:
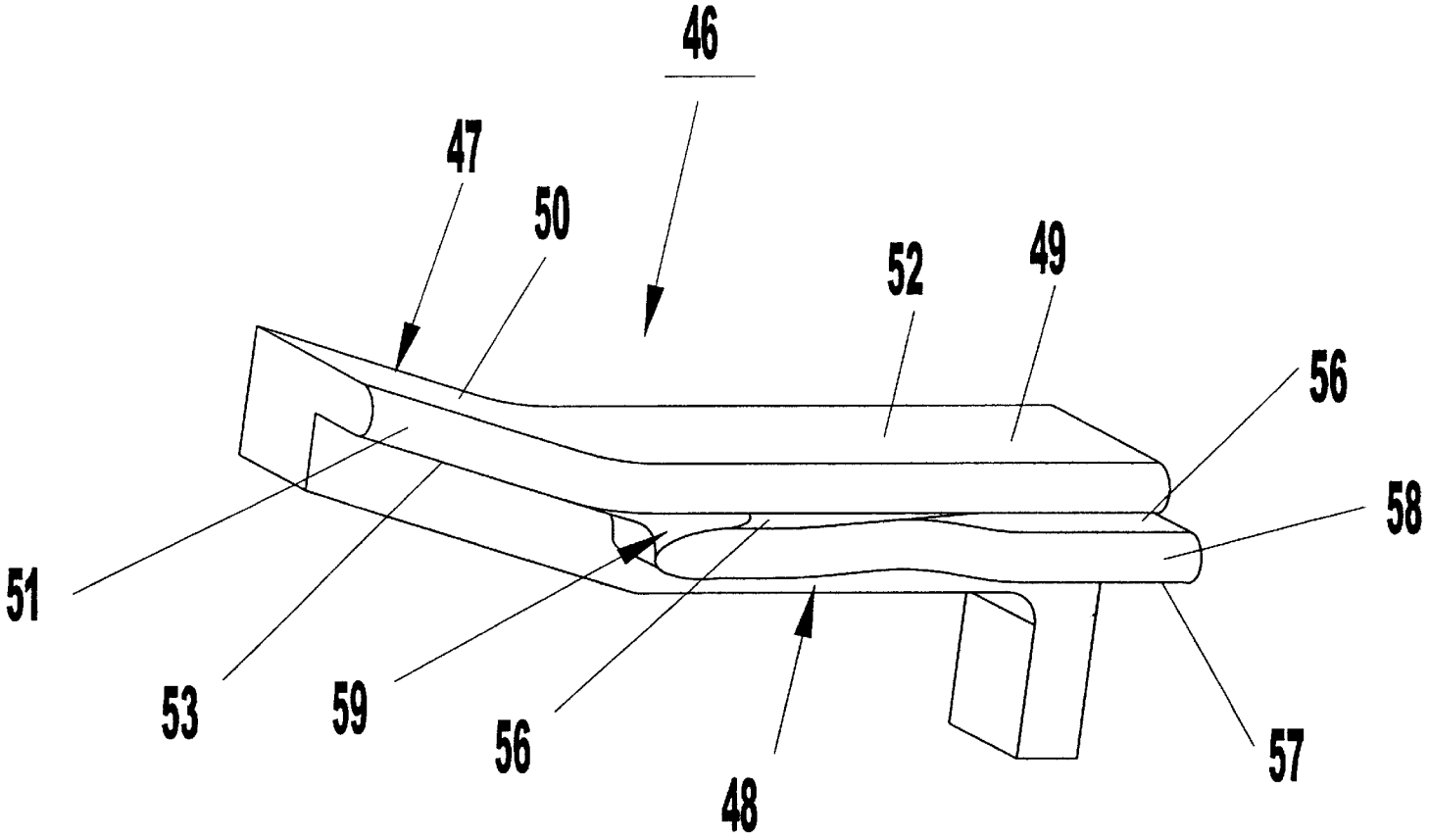
FIG. 5 is a perspective view of the label wrapping cam member employed in the label applying apparatus of the present invention.

Lower plate 48 is mounted below upper plate 47 in juxtaposed, spaced, vertical alignment therewith. In the preferred embodiment, lower plate 48 comprises top surface 56, bottom surface 57, and smooth, rounded side edge 58. In addition, lower plate 48 also comprises an overall length substantially equal to rear section 49 of upper plate 47. As best seen in FIG. 5, lower plate 48 is mounted in close proximity with bottom surface 53 of rear section 49 of upper plate 47 at the rear thereof. In addition, lower plate 48 gently slopes downwardly the front portion thereof, establishing gap 59 with upper plate 47.

Figure 6:
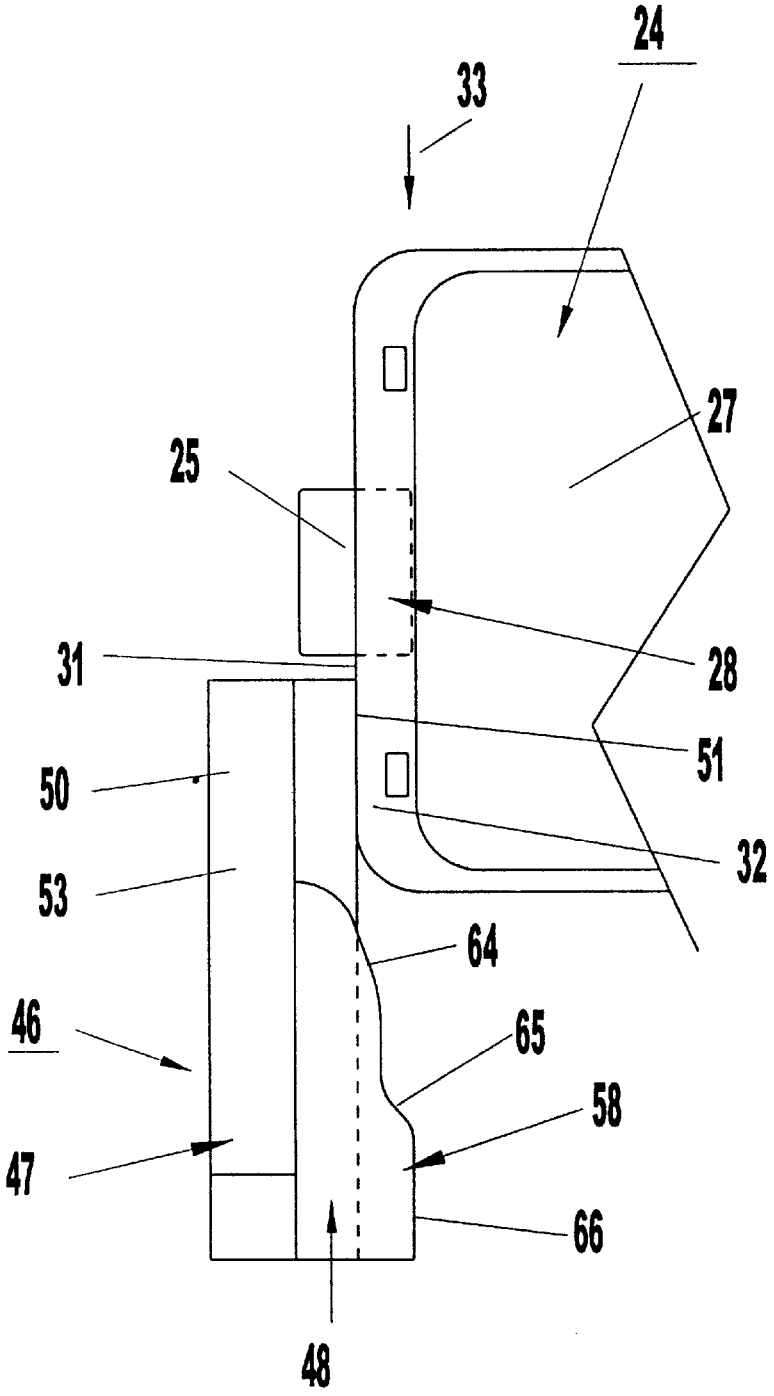
FIGS. 6–8 are bottom plan views of the label wrapping cam member of FIG. 5 shown in cooperating association with a container and label in various stages of wrapping the label to the protruding lip/flange of the container.
Figure 7:
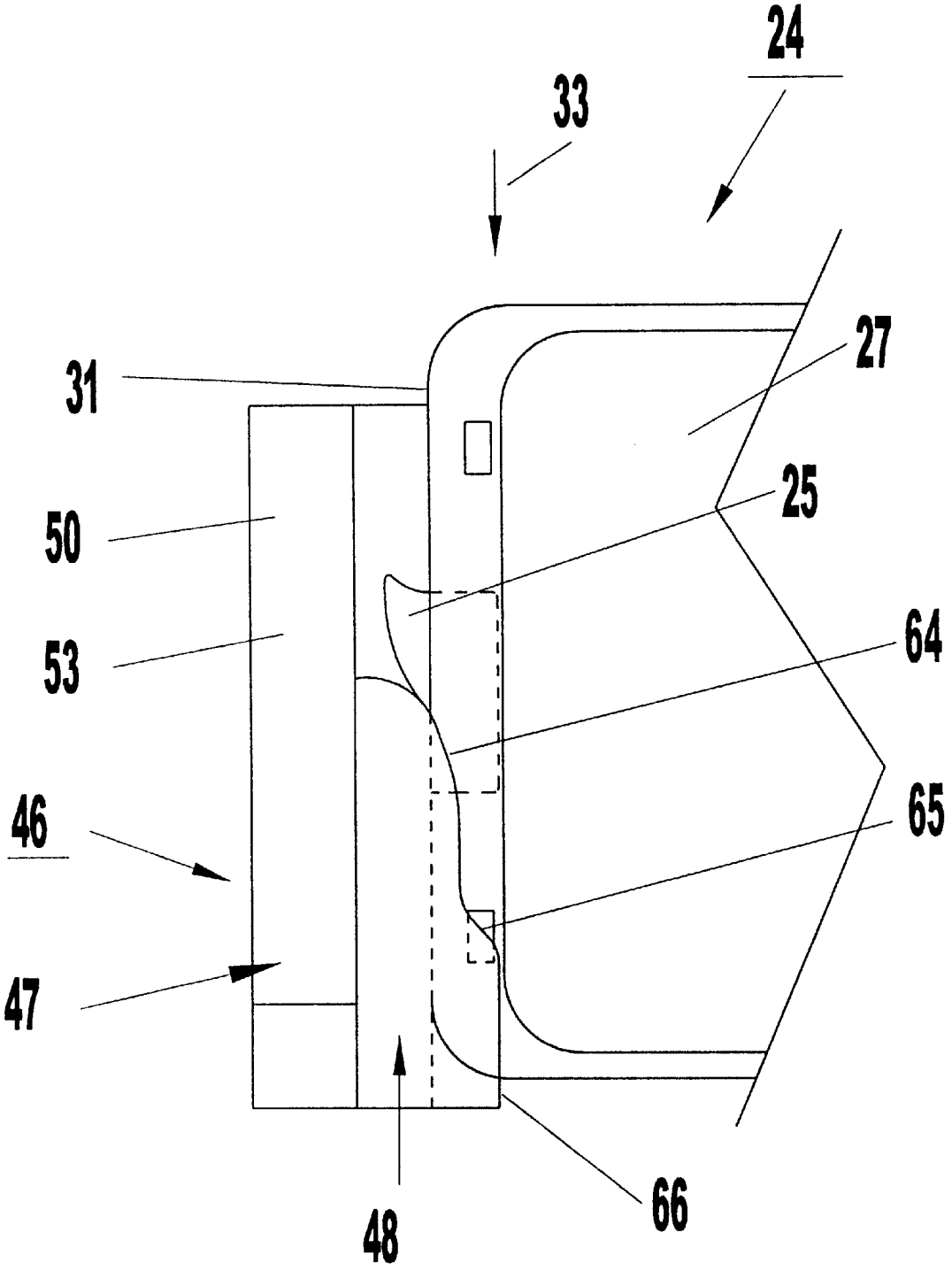
Figure 8:
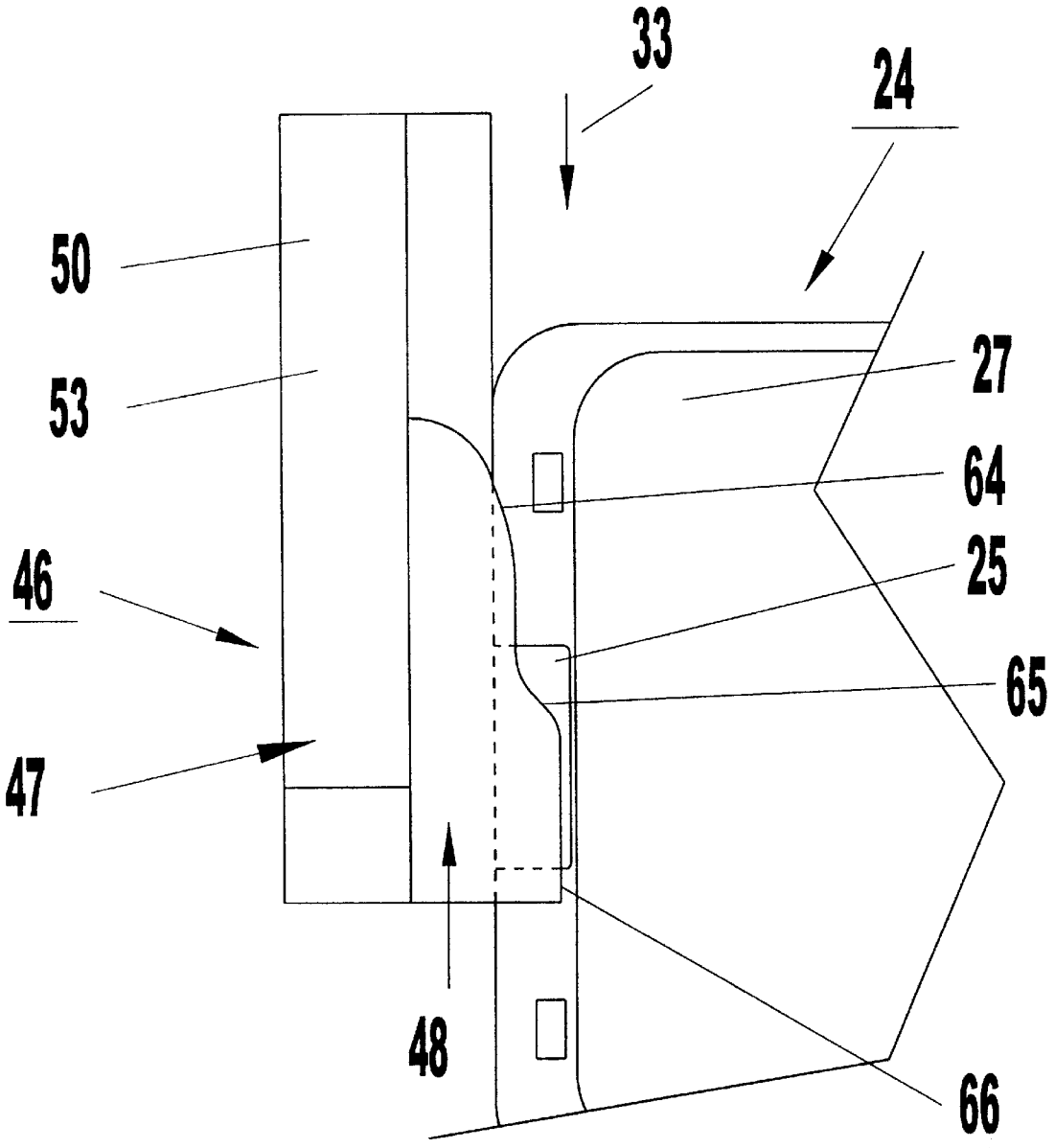

As best seen in FIGS. 6–8, the width of lower plate 48 varies throughout its length, thereby enabling side edge 58 to function as a label contacting and guiding cam surface. In the preferred construction, side edge 58 of lower plate 48 comprises curved zone 64, intermediate zone 65, and terminating zone 66. In this preferred construction, curved zone 64 of side edge 58 extends from the forwardmost tip of lower plate 48 in an arcuately curved manner which causes side edge 58 to initially be below bottom surface 53 of upper plate 47 and, about midway along its length, to extend outwardly from upper plate 47, causing side edge 58 of lower plate 48 to be positioned outwardly from side edge 51 of upper plate 47.

Intermediate zone 65 forms a smooth, arcuate transition between curved zone 64 and terminating zone 66. In this preferred embodiment, terminating zone 66 comprises a substantially straight section which is substantially parallel to side edge 51 of upper plate 47. However, terminating zone 66 is positioned outwardly from and spaced away from side edge 51 of upper plate 47 by a distance substantially equal to the width of the lip/flange 28 about which label 25 is being wrapped. In this way, as detailed below, the desired wrapping of label 25 is efficiently attained.

Figure 9:
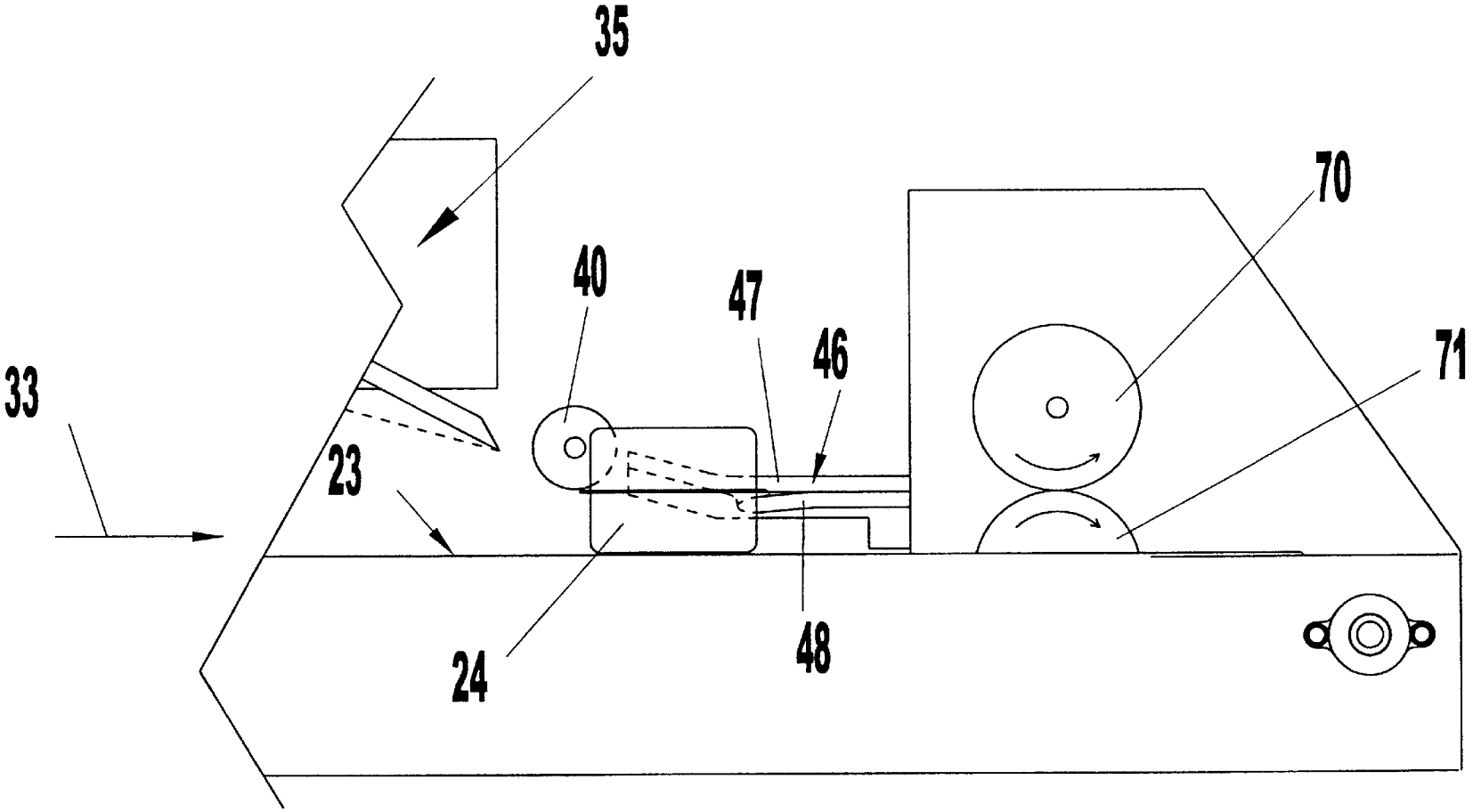
FIGS. 9 and 10 are side elevation views, partially broken away, of portions of the label applying apparatus of the present invention depicting alternate stages of the label applying process.

As detailed above, label 25 is affixed to top surface 30 of protruding lip/flange 28 of product container 24 by label dispensing station 35. Immediately thereafter, container 24, with label 25 horizontally extending therefrom, is advanced into cooperating engagement with label wrapping cam member 46, as shown in FIG. 9.

In the preferred construction, label wrapping cam member 46 is adjustable both vertically and horizontally in order to assure the precisely desired alignment of cam member 46 with container 24. In this regard, side edge 51 of rear section 49 of upper plate 47 is positioned at a vertical height from conveyor 23 which is substantially equivalent to the vertical height of flange 28 of container 24 from conveyor 23. As a result, as a container 24 is advanced into cooperating association with label wrapping cam member 46, wall member 31 of protruding lip/flange 28 is brought into sliding, frictional, guiding engagement with smooth, rounded, side edge 51 of upper plate 47.

As container 24 advances toward label wrapping cam member 46, wall member 31 of lip/flange 28 of container 24 passes sloping section 50 of upper plate 47 until the leading portion of wall member 31 reaches the juncture between sloping section 50 and rear section 49. At this time, wall member 31 is brought into sliding, guiding, frictional engagement with side edge 51 of rear section 49.

In view of the sloped angle of section 50 relative to rear section 49, label 25 passes below sloping section 50 in juxtaposed spaced relationship with bottom surface 53 thereof. However, as the leading edge of label 25 approaches the juncture between sloping section 50 and rear section 49, as shown in FIG. 6, smooth, rounded, side edge 51 causes label 25 to arcuately pivot downwardly, bringing label 25 into contact with the outer surface of wall member 31.

As container 24 continues to advance along label wrapping cam member 46, label 25 is arcuately pivoted into a position substantially perpendicularly to protruding lip/flange 28. Once in this position, as shown in FIG. 7, the leading edge of label 25 begins to contract curved zone 64 of side edge 58 of lower plate 48 in the area where side edge 58 extends horizontally away from edge 51 of upper plate 47.

As container 24 continues to advance relative to label wrapping cam member 46, the cam surface formed by side edge 58 continues to guide the movement of label 25 relative to lip/flange 28. In this regard, the movement of label 25 along arcuately curved zone 64 and intermediate zone 65 of edge 58 causes label 25 to be arcuately pivoted into overlying, juxtaposed, spaced relationship with bottom surface 32 of lip/flange 28. Finally, as shown in FIG. 8, when label 25 is advanced into contact with terminating zone 66 of side edge 58, label 25 is completely folded, causing the exposed top surface 56 of lower plate 58 to be brought into contact with label 25. This contact causes label 25 to be adhesively engaged with bottom surface 32 of lip/flange 28.

When container 24 emerges from cooperative engagement with label wrapping cam member 46, label 25 is wrapped about protruding lip/flange 28. However, label 25 is not intimately bonded in secure interengagement with lip/flange 28, since lower plate 48 is only able to bring label 25 into contact with bottom surface 32 of lip/flange 28. As a result, if additional secure affixation steps were not taken, label 25 would become dislodged from bottom surface 32 and return to its original horizontal configuration.

Figure 10:
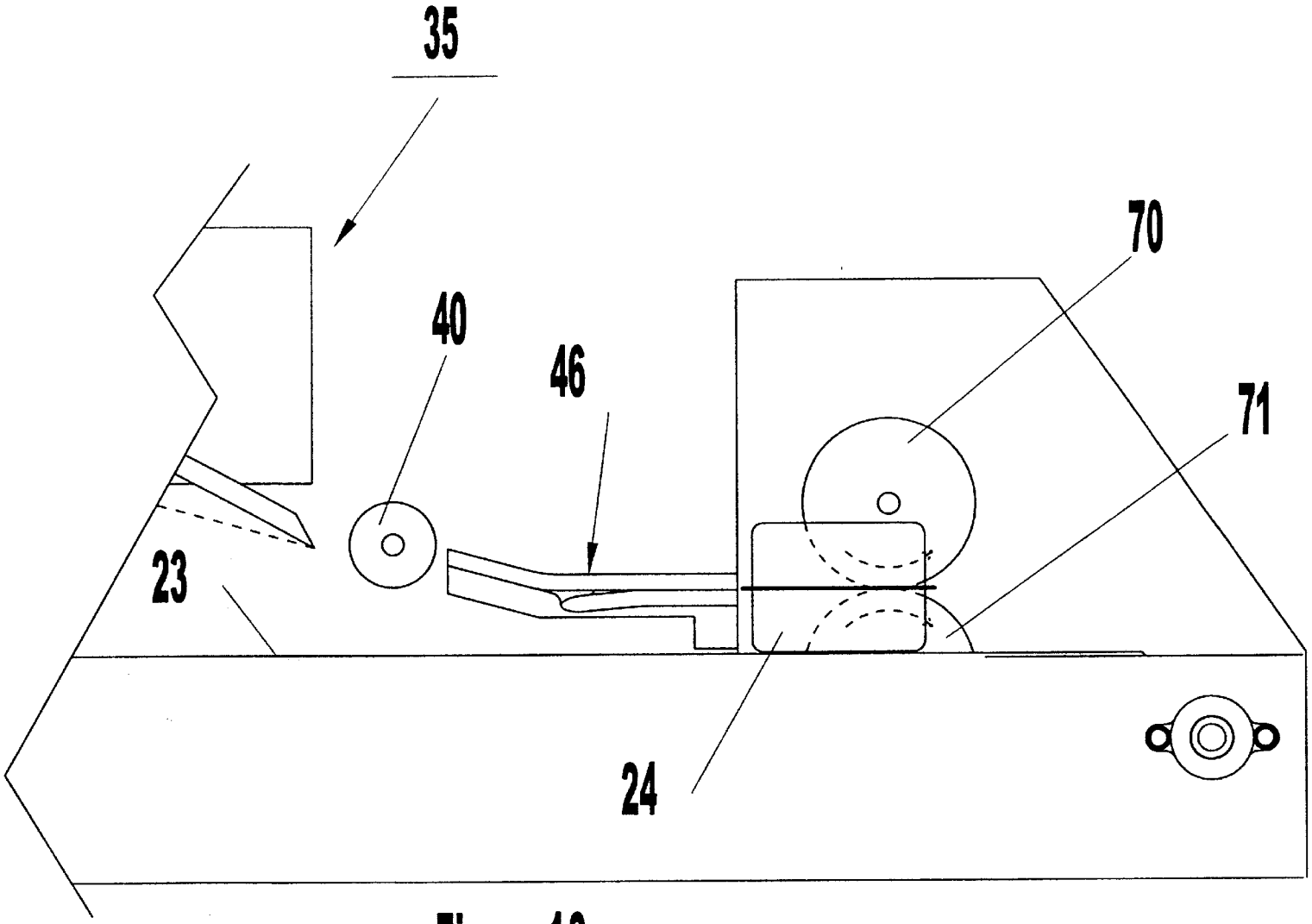
Figure 11:
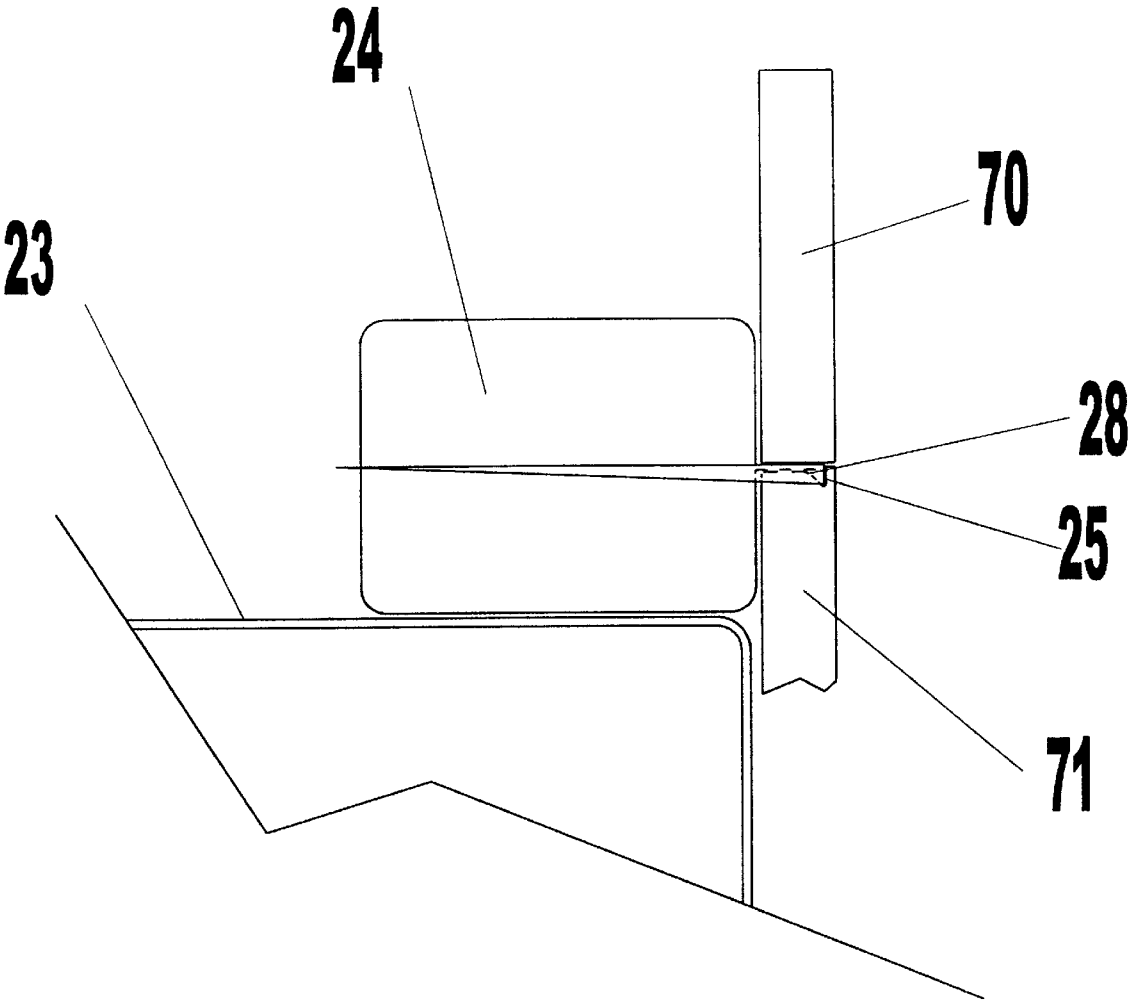
FIG. 11 is an end view depicting the cooperating rollers of the label applying apparatus of the present invention in combination with a container passing therethrough.

In order to assure the secure affixation of label 25 to protruding lip/flange 28 of container 24, container 24 is advanced by conveyor 23 into engagement with cooperating rollers 70 and 71, as shown in FIGS. 10 and 11. As depicted therein, rollers 70 and 71 are mounted in juxtaposed, spaced, cooperating relationship with each other. In this preferred construction, rollers 70 and 71 rotate about separate axes which are parallel to each other, with the outer surfaces of rollers 70 and 71 being in close proximity to each other, either in contact or spaced apart a sufficient distance which enables protruding lip/flange 28 of container 24 to pass therebetween, while still being compressed thereby.

By employing this construction, once label 25 has been wrapped about protruding lip/flange 28 of container 24 by label wrapping cam member 46, container 24 is advanced into cooperation with rollers 70 and 71 so as to cause protruding lip/flange 28 to pass between rollers 70 and 71. Due to the proximity of the outer surfaces of rollers 70 and 71 to each other, rollers 70 and 71 contact label 25, forcing label 25 into secure, bonded affixation with protruding lip/flange 28 of container 24. In this way, the desired securement of label 25 to lip/flange 28 of container 24 is achieved and a trouble-free, aesthetically pleasing tamper evident label is realized.

In order to accommodate the wide variety of constructions employed by manufacturers of product holding containers for the flange or lip associated therewith, it has been found that roller 70 is preferably formed from a comparatively hard material, while roller 71, either entirely or partially, is formed from a compressible material. In this regard, if roller 71 is formed partially from a compressible material, the material must be formed as the outer surface thereof which is brought into engagement with lip/flange 28 of container 24.

As best seen in FIG. 11, roller 70 contracts the top surface of protruding lip/flange 28 of container 24 which typically comprises a substantially flat surface. Consequently, roller 70 may comprise a generally conventional hard material in order to assure the securement of label 25 to top surface 30 of lip/flange 28. However, since the lower surface of lip/ flange 28 comprises vertically depending wall member 31 and flat bottom surface 32, roller 71 must be capable of compressibility and deflectability in order to contact flat bottom surface 32 without deforming vertically depending wall member 31.

In order to accommodate this configuration, roller 71 comprises compressible material which is capable of being deflected by wall member 31, while still being able to force label 25 into secure, bonded contacting engagement with the exposed surfaces of wall member 31 and bottom surface 32. By employing this construction, any flange or lip configuration is capable of being accommodated, with any desired tamper evident label being forced into secure, bonded, peripherally wrapped engagement with the flange or lip. As a result, all of the prior art difficulties and inabilities are overcome and a label applying and securing apparatus and method is realized which is capable of satisfying the long felt needs of this industry.

It will must be seen that the objects set forth above, among those made apparent from the preceding description, are efficiently attained and since certain changes may be made in carrying out the above process and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. Label applying apparatus for securely affixing and wrapping a label to a protruding flange of a container as the container advances on conveyor means with the label being affixed to the protruding flange of the container in substantial, continuous, uninterrupted contacted interengagement therewith, said apparatus comprising a label wrapping cam member comprising two overlying cam portions constructed for engaging the label and controllably wrapping the label about the protruding flange and a pair of rollers mounted in cooperating alignment with each other for simultaneously contacting an upper surface and a lower surface of the flange and forcing the label into secure, contacted engagement with the surfaces of the protruding flange of the container in secure, wrapped, contacting engagement therewith.

2. Label applying apparatus for securely affixing and wrapping a label to a protruding flange of a container as the container advances on conveyor means, said apparatus comprising:

A. a label dispensing head constructed for retaining a plurality of labels and sequentially advancing at least one label onto a surface of the forwardly protruding flange of the container; and B. a label wrapping cam member positioned in cooperating relationship with the label dispensing head and comprising first and second cooperating portions constructed for engaging the label and controllably forcing the label into wrapped contacted interengagement with the flange of the container in substantially continuous, uninterrupted, secure engagement therewith; and C. a pair of rollers positioned in cooperating relationship with the label wrapping cam member and constructed for receiving the label wrapped flange of the container and forcing the label into secure bonded, affixed engagement therewith;

whereby label applying apparatus is achieved which securely wraps a label about the forwardly protruding flange of a container in continuous, contacted, uninterrupted, secure, interengagement with the flange of the container, avoiding any substantial open zones or areas devoid of contact between the label and the flange.

3. The label applying apparatus defined in claim 2, wherein said label wrapping cam member comprises a first cam edge for guiding the movement of the protruding flange of the container along the length of said cam member, and a second cam edge for controllably, arcuately pivoting the label about the flange from an initial horizontal position to a fully wrapped position, wherein said label peripherally surrounds the protruding flange of the container.

4. The label applying apparatus defined in claim 3, wherein said first and second cooperating cam portions comprise a first plate and a second plate and the first cam edge is formed on the first plate of said label wrapping cam member and said second cam edge is formed on the second plate thereof, and said first and second plates are further defined as being mounted in juxtaposed, overlying relationship with each other.

5. The label applying apparatus defined in claim 4, wherein said second cam edge extends in an arcuately curved path from an initial position below the first plate to a second position spaced away from the first plate.

6. The label applying apparatus defined in claim 5, wherein said second cam edge is further defined as comprising a terminating section spaced away from said first plate a distance substantially equal to the width of the flange of the container.

7. The label applying apparatus defined in claim 6, wherein said second cam edge is further defined as comprising a smooth, continuous, rounded construction for assuring trouble free guiding movement of the label relative to the flange of the container.

8. The label applying apparatus defined in claim 4, wherein said first plate is further defined as comprising a forward section and a rear section with said forward section sloping upwardly away from said rear section, whereby the flange of the container is guided by the edge of said rear section allowing the horizontally protruding label mounted to the flange to slide below said first section as the container advances into cooperative association with the label wrapping cam member.

9. The label applying apparatus defined in claim 3, wherein said label wrapping cam member is further defined as being vertically adjustable relative to the conveyor means on which said product containers advance, in order to assure positioning of the first cam in the precisely desired location.

10. The label applying apparatus defined in claim 2, wherein said pair of rollers are further defined as being mounted in vertical alignment with each other, establishing an upper roller and a lower roller, with each roller being rotationally driven about substantially horizontal, vertically aligned, parallel axes.

11. The label applying apparatus defined in claim 10, wherein said pair of rollers are further defined as being mounted in close proximity with each other, establishing a small gap between the juxtaposed, spaced, facing, rotationally driven, outer surfaces thereof.

12. The label applying apparatus defined in claims 11, wherein said upper roller and said lower roller are vertically adjustable to assure the gap therebetween is aligned with the protruding flange of the container.

13. The label applying apparatus defined in claim 12, wherein said upper roller is positioned for having its outer surface in contacting engagement with a top surface of the protruding flange of the container, thereby assuring the label affixed thereto is forced into secure engagement therewith.

14. The label applying apparatus defined in claim 13, wherein said lower roller is positioned for having its outer surface in contacting engagement with a bottom surface of the protruding flange of the container, for assuring that the label peripherally wrapped about the flange is forced into secure bonded affixation with the bottom surface of the flange.

15. The label applying apparatus defined in claim 14, wherein said lower roller is further defined as comprising compressible material formed on at least the outer surface thereof for enabling the surface of the lower roller contacting the flange of the container to be capable of deformation in response to the shape of the flange, while still providing sufficient force for forcing the label into secure bonded engagement with the flange.

16. The label applying apparatus defined in claim 15, wherein said lower roller is further defined as being formed entirely from compressible material.

* * * * *